US005529684A

United States Patent [19]

Greaney et al.

[11] Patent Number: 5,529,684

[45] Date of Patent: Jun. 25, 1996

[54] METHOD FOR DEMETALLATING REFINERY FEEDSTREAMS

[75] Inventors: Mark A. Greaney, Upper Black Eddy, Pa.; Michael C. Kerby, Jr., Baton Rouge, La.; William N. Olmstead, Murray Hill; Irwin A. Wiehe, Gladstone, both of N.J.

[73] Assignee: Exxon Research and Engineering Company, Florham Park, N.J.

[21] Appl. No.: 440,438

[22] Filed: May 12, 1995

Related U.S. Application Data

[63] Continuation-in-part of Ser. No. 365,379, Dec. 27, 1994, abandoned.

[51] Int. Cl.[6] ..... C10G 32/00

[52] U.S. Cl. ..... 205/688; 205/695; 205/696

[58] Field of Search ..... 204/136, 188, 204/190; 205/688, 695, 696

[56] References Cited

U.S. PATENT DOCUMENTS

| | | | |
|---|---|---|---|
| 3,344,045 | 9/1967 | Neikam | 204/59 |
| 3,457,152 | 7/1969 | Maloney et al. | 204/131 |
| 3,700,572 | 10/1972 | Hatayania et al. | 204/73 R |
| 3,857,770 | 12/1974 | Keller | 204/188 |
| 3,915,819 | 10/1975 | Bell et al. | 204/136 |
| 4,187,156 | 2/1980 | Coleman et al. | 204/73 R |
| 5,059,332 | 10/1991 | Satoh | 210/771 |

OTHER PUBLICATIONS

Sitnikova, et al., Petrol. Chem. vol. 32, No. 5, pp. 349–359 (1992) "Microelements in Crude Oils and Certain Ecological Problems" (no month).

Danly, "Devel. and Commerc. of the Monsanto Electrochem. Adiponitrile Process", Ch. 7, pp. 147–164, in Electrosynthesis from Laboratory to Pilot to Production, J. D. Genders, D. Fletcher, eds., publ. The Electrosynthesiss Co., E. Amherst, N.Y. (1990) (no month).

Branthaver, "Influence of Metal Complexes in Fossil Fuels on Industrial Operations", Ch. 12, pp. 189–206, R. H. Filby and J. F. Branthaver, eds., ACS, Washington, D.C. (1987) no month.

*Primary Examiner*—Arun S. Phasge

*Attorney, Agent, or Firm*—Linda M. Scuorzo

[57] ABSTRACT

The present invention provides for a method of decreasing the metals content of metal containing petroleum streams by forming a mixture of the petroleum fraction containing those metals and an essentially aqueous electrolysis medium, and passing an electric current through the mixture at a voltage, pH and time sufficient to remove the metals such as Ni, V and Fe from the stream (i.e. to produce a petroleum fraction having decreased content of the metals). The cathodic voltage is from 0 V to −3.0 V vs. SCE at a pH of from 6 to 14, preferably 7 to 14, most preferably above 7 to 14.

The invention provides a method for enhancing the value of petroleum feeds that traditionally have limited use in refineries due to their Ni and V content.

14 Claims, No Drawings

METHOD FOR DEMETALLATING REFINERY FEEDSTREAMS

CROSS REFERENCE TO RELATED APPLICATIONS

This application is a continuation-in-part application of Ser. No. 365,379, filed Dec. 27, 1994 now abandoned.

FIELD OF THE INVENTION

The present invention relates to a method for electrochemically demetallating refinery feedstreams.

BACKGROUND OF THE INVENTION

Petroleum streams that contain metals are typically problematic in refineries as streams because the metallic components contained therein have a negative impact on certain refinery operations. Thus, demetallation has been referred to as critical to help conversion of crude fractions (see e.g., Branthaver, Western Research Institute in Ch.12, "Influence of Metal Complexes in Fossil Fuels on Industrial Operations", Am. Chem. Soc. (1987)). Such metals, for example, act as poisons for hydroprocessing and fluid catalytic cracking catalysts, thereby, shortening the run length of such processes, increasing waste gas make and decreasing the value of coke product from coker operations.

The presence of such metals prevents more advantageous use of the petroleum stream by rendering especially the heaviest oil fractions (in which these metal containing structures most typically occur) less profitable to upgrade, and when these resources are used make catalyst replacement/disposal expensive and environmentally hazardous. Current refinery technologies typically address the problem by using metal containing feedstreams as a less preferred option, and by tolerating catalyst deactivation when there are not other feedstream alternatives available.

Electrochemical processes have been used for removal of water soluble metals from aqueous streams, see e.g., U.S. Pat. No. 3,457,152. However, the metals of interest here in petroleum streams are typically associated with hydrocarbon species, and are not readily water soluble. There is a need for an effective method for removal of these metals. Applicants' invention addresses this need.

SUMMARY OF THE INVENTION

The present invention provides for a method for removing metals, preferably Ni and V, from petroleum streams containing these metals, comprising passing an electric current through a mixture of the metals containing petroleum stream and an aqueous electrolysis medium, for a time sufficient to remove the metal contaminants. The process may also be used to remove metals, such as Fe, that are more easily removed than Ni and V.

The present invention may suitably comprise, consist or consist essentially of the described elements and may be practiced in the absence of an element not disclosed.

DETAILED DESCRIPTION OF THE INVENTION

The present invention provides for a method for decreasing the metals content of a petroleum fraction by subjecting a mixture or solution of a hydrocarbonaceous petroleum fraction (also referred to herein as a stream or feed) containing the metal and an aqueous electrolysis medium to an electric current for a time sufficient to remove the metals from the stream (i.e. to produce a petroleum fraction having decreased content of the metals). The petroleum stream and aqueous electrolysis medium are contacted under conditions to result in passing of an electric current therethrough.

The metallic contaminants that may be removed include Ni and V species, as these are typically present in petroleum streams and are not removed advantageously or cost-effectively by other demetallation treatments. Transition metals such as Ni and V are often found, for example, in porphyrin and porphyrin-like complexes or structures, and are abundant as organo-metallic contaminants in heavy petroleum fractions. In these feeds such metal species tend to be found in non-water soluble or immiscible structures. Iron also may be removed by the process.

By contrast, water soluble metal salts typically are currently removed from petroleum streams using an electrostatic desalter process. This process entails applying an electric field to aid in separation of water and petroleum phases. The water soluble metal salts are thereby extracted and removed from the petroleum streams. By contrast to the present invention, high voltage is applied in the absence or essential absence of current flow and the metals that are removed are essentially not hydrocarbon soluble.

The process of this invention also may be applied to the removal of metals that are more easily reduced than Ni and V, such as Fe. However, since other processing options are available for removal of such other metals, the process is most advantageous for removal of the metals Ni, V, as these are not suitably removed by other processes. A benefit of the process of the present invention is in its use to remove metals contained in typically non-water extractable metal containing moieties.

Examples of Ni and V metal-containing petroleum streams or fractions, including distillates thereof that may be treated according to the process of the present invention are metal containing carbonaceous and hydrocarbonaceous petroleum streams of fossil fuels such as crude oils and bitumens, as well as processed streams (distillation resids) such as atmospheric vacuum resid, fluid catalytic cracker feeds, metal containing deasphalted oils and resins, processed resids and heavy oils (heavy crudes) as these typically have a high metals content.

The feed to be demetallized can have a range of vanadium and/or nickel content. The average vanadium in the feed is typically about 15 ppm to 2,000 ppm, preferably about 20 to 1,000 ppm, by weight, most preferably about 20 to 100 ppm. The average nickel content in the starting feed is typically about 2 to 500 ppm, preferably about 2 to 250 ppm by weight, most preferably about 2 to 100 ppm. For example, a Heavy Arab crude distillate having an initial cut point of 950° F. (510° C.) and a final cut point of 1160° F. (627° C.) may have a typical nickel content of 8 ppm and a vanadium content of 50 ppm by weight. However, any level of nickel and/or vanadium may be treated according to the present invention.

The metal containing petroleum fraction to be contacted with the aqueous electrolysis medium preferably should be in a liquid or fluid state at process conditions. This may be accomplished by heating the material or by treatment with a suitable solvent as needed. This assists in maintaining the mixture of the metal containing petroleum stream and aqueous electrolysis medium in a fluid form to allow passage of an electric current. Current densities of 1 mA/cm$^2$ of cathode surface or greater area are suitable.

Preferably droplets should be of sufficient size to enable the metals containing components to achieve intimate contact with the aqueous electrolysis medium. Droplet size particles of about 0.1 micron to 1.0 mm, for example are suitable. Desirably the process should be carried out for a time and at conditions within the ranges disclosed sufficient to achieve a decrease, preferably a maximum decrease, in content of the metals. Contacting is typically accomplished by intimate mixing of the metal containing petroleum stream and the aqueous electrolysis medium to form a mixture or oil-in-water dispersion, for example using a stirred batch reactor or turbulence promoters in flowing cells.

Reaction temperatures will vary with the particular petroleum stream due to its viscosity, and the type of electrolyte and its pH. However, temperatures may suitably range up to about 700° F. (371° C.), preferably from 100° F. (38° C.) to 200° F. (93° C.), and pressures of from 0 atm (0 kPa) to 210 atm (21,200 kPa), preferably 1 atm (101 kPa) to 3 atm (303 kPa). An increase in temperature may be used to facilitate removal of metal species. Within the process conditions disclosed a liquid or fluid phase or medium is maintained.

Following demetallation, the product petroleum stream contains a reduced level of Ni and/or V and/or Fe content. While the actual amount removed will vary according to the starting feed, on average, vanadium levels of not more than about 15 ppm by weight, preferably less than about 4 ppm and on average nickel levels of less than about 10 ppm, preferably less than about 2 ppm can be achieved. Greater than 30 percent by weight of the total vanadium and nickel can thereby be removed.

The metal contaminant-reduced product may be used in refining operations that are adversely affected by higher levels of metals, for example fluid catalytic cracking or hydroprocessing, or such a product can be blended with other streams of higher or lower metals content to obtain a desired level of metallic contaminants.

The electrolyte in the aqueous electrolysis medium is desirably an electrolyte that dissolves or dissociates in water to produce electrically conducting ions, but that does not undergo redox in the range of applied potentials used. Organic electrolytes include quaternary carbyl and hydrocarbyl onium salts, e.g. alkylammonium hydroxides. Inorganic electrolytes include, e.g., NaOH, KOH and sodium phosphates. Mixtures thereof also may be used. Suitable onium ions include mono- and bis-phosphonium, sulfonium and ammonium, preferably ammoniumions. Carbyl and hydrocarbyl moieties are preferably alkyl. Quaternary alkyl ammonium ions include tetrabutyl ammonium, and tetrabutyl ammonium toluene sulfonate. Optionally, additives known in the art to enhance performance of the electrodes or the system may be added such as surfactants, detergents, emulsifying agents and anodic depolarizing agents. Basic electrolytes are most preferred. The concentration of salt in the electrolysis medium should be sufficient to generate an electrically conducting solution in the presence of the petroleum component. Typically a concentration of 1–50 wt % aqueous phase, preferably 5–25 wt % is suitable. The pH of the solution of the petroleum fraction in the aqueous electrolysis medium will vary with the metals to be removed with higher pH typically used for metal containing species that are more difficult to remove.

Within the process conditions disclosed, the pH of the aqueous electrolysis medium can vary from 6 to 14, preferably 7 to 13, or 7 to 14 most preferably from above 7 to 13, or from above 7 to 14.

It is preferred to carry out the process under an inert atmosphere. A benefit to the present invention is that the process may be operated under ambient temperature and atmospheric pressure, although higher temperature and pressures also may be used as needed. Its most basic form is carried out in an electrochemical cell, by electrolytic means, i.e. in a non-electrostatic mode, as passage of current through the mixture or oil-in-water dispersion is required (e.g., relatively low voltage/high current). The cell may be either divided or undivided. Such systems include stirred batch or flow through reactors. The foregoing may be purchased commercially or made using technology known in the art. Electrodes having high hydrogen over potential, e.g., Hg, Pb, Sn, Zn, carbon or alloys thereof are typically needed as cathodes for removal of metals such as Ni or V. Other suitable electrodes known in the art may be used for other metals. Included as suitable electrodes are three-dimensional electrodes, such as carbon or metallic foams. The cathodic voltage will vary depending on the metal to be removed. The cathodic voltage is in the range 0 to −3.0 V versus Saturated Calomel Electrode (SCE), preferably −1.0 to −2.5 V based on the characteristics of the particular petroleum fraction. While direct current is typically used, electrode performance may be enhanced using alternating current, or other voltage/current waveforms.

The invention may be described with reference to the following non-limiting examples.

EXAMPLE 1

Metal Removal from Crude Oil

The electrochemical cell used in this study was a commercially available coulometry cell (Princeton Applied Research) consisting of a mercury pool cathode, a platinum wire anode, a standard calomel reference electrode, and a glass stirring paddle. A mixture of South Louisiana Crude Oil (API approx. 35) (10 mL) and an aqueous solution of 40 wt % tetra-butyl ammonium hydroxide (30 mL) was added to the electrochemical cell. The solution was purged under nitrogen (1 atm). The applied potential was set at −2.2 V vs SCE and the solution stirred. After 6 h the stirring was stopped and the aqueous/crude oil mixture was allowed to separate. The crude oil was removed and analyzed for vanadium by electron paramagnetic resonance spectroscopy (EPR).

| | Starting Feed | Product |
|---|---|---|
| V (ppm) | 28 | 17 |

As a control, the experiment was repeated as described above, except that no voltage was applied to the mixture. The vanadium content of the crude oil remained 28 ppm, thus ruling-out the possibility of metal removal by extraction into the aqueous phase.

EXAMPLE 2

Metals Removal from Bitumen

The same equipment was used as in Example 1. A Cold Lake bitumen (API approx. 11) (10 mL) and an aqueous solution of 40 wt % tetra-butyl ammonium hydroxide (20 mL) was added to the electrochemical cell. The solution was purged under nitrogen (1 atm). The applied potential was set at −2.8 V vs. SCE and the solution stirred. After 6 h the stirring was stopped and the aqueous/bitumen mixture was allowed to separate. The treated bitumen was removed and analyzed for metals by inductively coupled Plasma emission spectroscopy (ICP).

| | Starting Feed | Product |
|---|---|---|
| V (ppm) | 172 | 96 |
| Ni (ppm) | 73 | 52 |
| Fe (ppm) | 39 | 25 |

A control experiment was also run with no passage of current. The metals content of the bitumen showed within the range of experimental error no decrease in metal content without the passage of current.

EXAMPLE 3

Metals Removal from Athabasca Atmospheric Resid

The same equipment was used as in Example 1. A 3.2 g sample of Athabasca atmospheric resid was diluted (to decrease viscosity) with 10 mL toluene and added to an aqueous solution of 40 wt % tetra-butyl ammonium hydroxide (20 mL) in the electrochemical cell. The solution was purged under nitrogen (1 atm). The applied potential was set at −2.8 V vs. SCE and the solution stirred. After 18 h the stirring was stopped and the aqueous/organics mixture was allowed to separate. The toluene was evaporated and the treated resid was analyzed by ICP.

| | Starting Feed | Product |
|---|---|---|
| V (ppm) | 205 | 155 |
| Ni (ppm) | 88 | 53 |
| Fe (ppm) | 806 | 32 |

EXAMPLE 4

Metals Removal from Light Arab Atmospheric Resid

The same equipment was used as in Example 1. A 1.7 g sample of Light Arab atmospheric resid (API approx. 14) was diluted with 10 mL toluene and added to an aqueous solution of 40 wt % tetra-butyl ammonium hydroxide (20 mL) in the electrochemical cell. The solution was purged under nitrogen (1 atm). The applied potential was set at −2.5 V and the solution stirred. After 18 h the stirring was stopped and the aqueous/resid mixture was allowed to separate. The toluene was evaporated and the treated resid was analyzed by ICP, with the following results:

| | Starting Feed | Product |
|---|---|---|
| V (ppm) | 38 | 18 |
| Ni (ppm) | 10 | 5 |
| Fe (ppm) | 14 | 5 |

EXAMPLE 5

Metals Removal from Light Arab Atmospheric Resid at 25° and 100° C.

The same equipment was used as in Example 1. A stock solution of Light Arab atmospheric resid (API approximately 14) in diphenylmethane (bp=264° C.) was prepared by dissolving 16.94 g of light Arab atmospheric resid in 100 ml diphenylmethane and stirring at 40° C. for 30 minutes. 10 mls of this solution was added to an aqueous solution of 40 wt % tetra-butyl ammonium hydroxide (20 mL) in the electrochemical cell. The solution was purged under nitrogen (1 atm). The applied potential was set at −2.5 V vs. SCE and the solution stirred. After 18 h the stirring was stopped and the aqueous/resid mixture was allowed to separate. The treated resid was removed and the sample was analyzed by EPR (without removal of the diluent). The experiment was repeated as in the preceding paragraph except that the coulometry cell was placed in an oil bath at 100° C. during the experiment.

The results as shown below demonstrate that an increase in temperature may be used in the process of the present invention to further decrease metals content in the product.

| V (ppm) | Starting Feed* | Product* |
|---|---|---|
| 25° C. | 6 | 3 |
| 100° C. | 6 | 2 |

*including diluent

Control experiments were run at 25° C. and 100° C. The results indicate that the vanadium concentration in the diluted resid remained unchanged from the starting feed: 6 ppm.

EXAMPLE 6

Metals Removal from South Louisiana Vacuum Resid in a Flowing Electrochemical Cell 100 g of South Louisiana vacuum resid (API Approximately 12) was fluxed with 100 mL toluene and then mixed with 100 mL of an aqueous mixture of 10 wt % sodium hydroxide and 5 wt % tetrabutyl ammonium hydroxide. This solution was stirred vigorously, heated to 60° C. and then passed through a commercially available flowing electrochemical cell (FMO1-LC Electrolyzer built by ICI Polymers and Chemicals). In this cell the solution passes through an interelectrode gap between two flat plate electrodes. The cathode in this case was lead and the anode was stainless steel. The mixture was continuously recirculated through this cell during which time a controlled current of 1.5 amps was applied. The solution then was allowed to separate and the vanadium content of the resid (after the evaporation of toluene) was determined by X-ray fluorescence.

| | Starting Feed | Product |
|---|---|---|
| V (ppm) | 15 | 8 |

A control experiment was conducted by recirculating an identical solution through the cell for 5 h. as described above and the vanadium content of the resid was found to remain at 15 ppm.

COMPARATIVE EXAMPLE 1

Exposure of Crude Oil to High Voltage but low Current in a Desalter does not lead to Metals Removal Samples of crude oil were taken before and after passage through two commercially operating desalting units and examined by X-ray fluorescence. In the typical operation of these units, 7 wt % of water and demulsifying chemicals is added to the crude oil. The mixture was heated to 285° F. and passed through a vessel which contained three sets of conducting metal grids to which was applied a direct current of 500 V. Due to the low conductivity of the oil-water mixture, the actual current passed by these electrodes was small. The high voltage electrostatic field is created in order to aid in the coalescence of the water droplets in the crude oil, facilitating their separation by gravity. The water contains water-soluble salt, such as sodium chloride and this "desalting" process reduces the sodium chloride content of the crude. Within the range of experimental error, the V and Ni content of the crude was not reduced, as shown below. This reflects the water-insoluble character of the Ni and V found in crude oils.

| Sample | ppm V | ppm Ni |
|---|---|---|
| Before desalter #1 | 28 | 9 |
| After desalter #1 | 28 | 9 |
| Before desalter #2 | 27 | 15 |
| After desalter #2 | 27 | 13 |

What is claimed is:

1. A process for demetallating petroleum streams, comprising: subjecting a metals containing petroleum stream wherein the metals are hydrocarbon soluble and an aqueous electrolysis medium to a sufficient electric current, pH and a time to electrolytically demetallate the petroleum stream.

2. The process of claim 1 wherein the metals are selected from the group consisting of nickel and vanadium.

3. The process of claim 1 wherein the metal is iron.

4. The process of claim 1 wherein the electric current is at a cathodic voltage in the range of 0 to −3.0 V vs. SCE.

5. The process of claim 1 wherein the electric current is at a cathodic voltage of from about −1.0 to −2.5 V vs. SCE.

6. The process of claim 1 wherein the petroleum stream is selected from the group consisting of crude oils, catalytic cracker feeds, bitumen, and distillation resids.

7. The process of claim 1 wherein the aqueous electrolysis medium contains salts selected from the group consisting of inorganic salts, organic salts and mixtures thereof.

8. The process of claim i wherein the aqueous electrolysis medium has a pH of from 6 to 14.

9. The process of claim 1 wherein the aqueous electrolysis medium has a pH of from 7 to 14.

10. The process of claim 1 wherein the aqueous electrolysis medium has a pH of from above 7 to 14.

11. The process of claim I wherein the temperature is up to 700° F. (371° C.).

12. The process of claim 1 wherein the pressure is from about 0 atm (0 kPa) to about 210 atm (21,200 kPa).

13. The process of claim I wherein the concentration of the electrolyte in the aqueous electrolysis medium is 1 to 50 wt %.

14. The process of claim 1 wherein the metals containing petroleum stream and aqueous electrolysis medium form an oil in water dispersion.

* * * * *